US005358163A

United States Patent [19]

Naka

[11] Patent Number: 5,358,163

[45] Date of Patent: Oct. 25, 1994

[54] SUCTION ROLL FOR CONVEYING A FLEXIBLE STRIP

[75] Inventor: Kazuyuki Naka, Nagaokakyo, Japan

[73] Assignee: Murata Manufacturing Co., Ltd, Japan

[21] Appl. No.: 31,591

[22] Filed: Mar. 16, 1993

[30] Foreign Application Priority Data

Mar. 19, 1992 [JP] Japan ..... 4-63252

[51] Int. Cl.[5] ..... B41F 5/16

[52] U.S. Cl. ..... 226/97; 226/95

[58] Field of Search ..... 226/93, 95, 97, 190

[56] References Cited

U.S. PATENT DOCUMENTS

| | | | |
|---|---|---|---|
| 3,587,962 | 6/1971 | Herzhoff et al. | 226/95 |
| 4,207,998 | 6/1980 | Schmid | 226/95 |
| 5,230,456 | 7/1993 | Germann et al. | 226/95 |

FOREIGN PATENT DOCUMENTS

| | | | |
|---|---|---|---|
| 43757 | 3/1984 | Japan | 226/95 |
| 854936 | 11/1960 | United Kingdom | 226/95 |

OTHER PUBLICATIONS

Western Electric, "A Self Correcting System for Maintaining Alignment of Webs Between Vacuum Drums," Hetherington, J. C., Jul., 1973.

IBM Technical Disclosure Bulletin, "Feeding Perforated Tape", Streeter, D. N.; vol. 2, No. 3, Oct., 1959.

*Primary Examiner*—Daniel P. Stodola
*Assistant Examiner*—John P. Darling
*Attorney, Agent, or Firm*—Ostrolenk, Faber, Gerb & Soffen

[57] ABSTRACT

A roll body has inside a plurality of suction holes extending along the axis of the roll body such that the suction holes make a concentric circle within the roll body and has a large number of pores connecting each suction hole with the circumferential surface of the roll body. A shaft protrudes from the roll body at one side, and the shaft is covered with a housing. The housing is connected with a vacuum suction device, and the air pressure in the housing is negative. In the housing, ends at one side of the suction holes reach the circumferential surface of the shaft, and a belt is wound around the shaft. While the roll body is rotating to convey a strip wound therearound, the belt wound around the shaft opens the ends of suction holes which communicate with pores being in contact with the strip and closes the ends of suction holes which communicate with pores being out of contact with the strip.

5 Claims, 5 Drawing Sheets

SUCTION ROLL FOR CONVEYING A FLEXIBLE STRIP

BACKGROUND OF THE INVENTION

1. Field of the Invention

The present invention relates to a suction roll for conveying in one direction a strip of flexible material such as a strip of paper, a resin film or a strip of sheet metal.

2. Description of Related Art

Conventionally, a suction roll for conveying a strip of flexible material has many pores on its circumference, and the pores are connected with a vacuum suction device such as a blower. While the air pressures in the pores are negative, the circumference of the suction roll holds the strip of flexible material.

Practically, only about a half of the circumference of the suction roll is in contact with the strip of flexible material, and the other half does not contribute to the suction of the strip. The pores on the latter half of the circumference are open to the outside, and the vacuum suction device takes in air through these pores. This lowers the efficiency of the vacuum suction device, thereby requiring a large-sized apparatus.

It is a conventional way of solving this problem that the half of the circumference of the suction roll which is out of contact with the strip is covered with a resin seal. In this way, however, the following problems occur: (1) even if a material which has a high abrasion resistance is used for the seal, the seal is abraded easily because of its function and must be exchanged frequently; (2) because dust is caused by the abrasion of the seal, the suction roller is not suitable for use in a clean room; (3) because the seal covers a large part (about the half) of the suction roll, a large power is required to rotate the suction roll; (4) processing of the surface of the seal which will be in contact with the suction roll and regulation of the pressure of the seal on the suction roll are difficult; and (5) because the seal cannot seal the pores perfectly, it is impossible to completely prevent the vacuum suction device from taking in air through the pores.

SUMMARY OF THE INVENTION

An object of the present invention is to provide a suction roll which does not allow a vacuum suction device to take in air through pores without a seal and has a high suction efficiency.

In order to attain the object, a suction roll according to the present invention has in a roll body, a plurality of suction holes extending in a direction of the axis of the roll body such that the suction holes make a concentric circle in the roll body, and a large number of pores connecting each suction hole with a circumferential surface of the roll body, and the suction holes are connected with and cut off from a negative pressure side by opening/closing means. The opening/closing means operates in accordance with rotation of the roll body to connect suction holes which communicate with pores that are in contact with a conveyed strip with the negative pressure source and to cut off suction holes which communicate with pores that are out of contact with the strip from the negative pressure source.

As the roll body is rotating, the pores which are in contact with the strip are changing in the rotating direction. The opening/closing means operates in accordance with the change of the pores. The opening/closing means connects a suction hole communicating with pores which have come into contact with the strip with the negative pressure side, and thereby, the strip receive suction from the pores. On the other hand, the opening/closing means cuts off a suction hole communicating with pores which have separated from the strip from the negative pressure side. With this structure, the negative pressure side is never connected with pores which are open to the outside and therefore never takes in air. Consequently, the efficiency of the vacuum suction device is improved, and the problems caused by using a seal can be avoided.

BRIEF DESCRIPTION OF THE DRAWINGS

This and other objects and features of the present invention will be apparent from the following description with reference to the accompanying drawings in which.

DETAILED DESCRIPTION OF THE PREFERRED EMBODIMENTS

Figure 1:
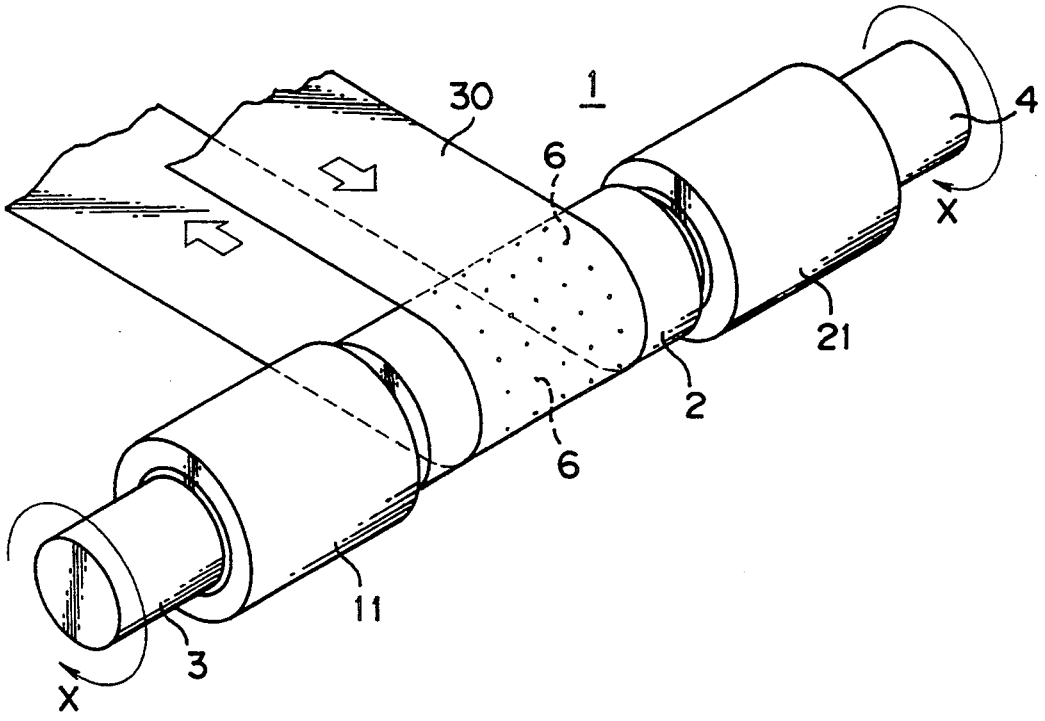
FIG. 1 is a perspective view of a suction roll which is a first embodiment of the present invention.
Figure 2:
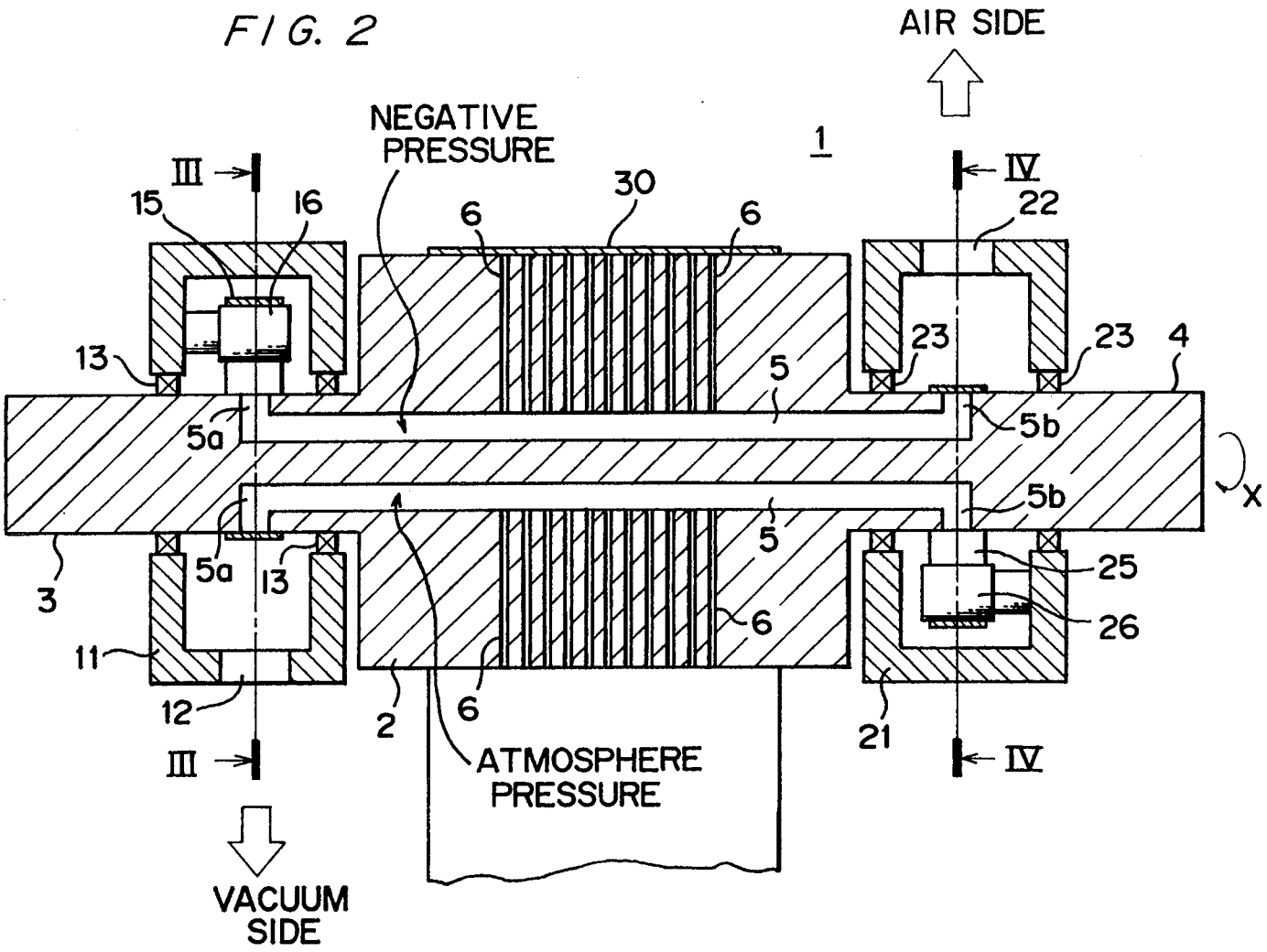
FIG. 2 is an elevational sectional view of the suction roll shown in FIG. 1.
Figure 3:
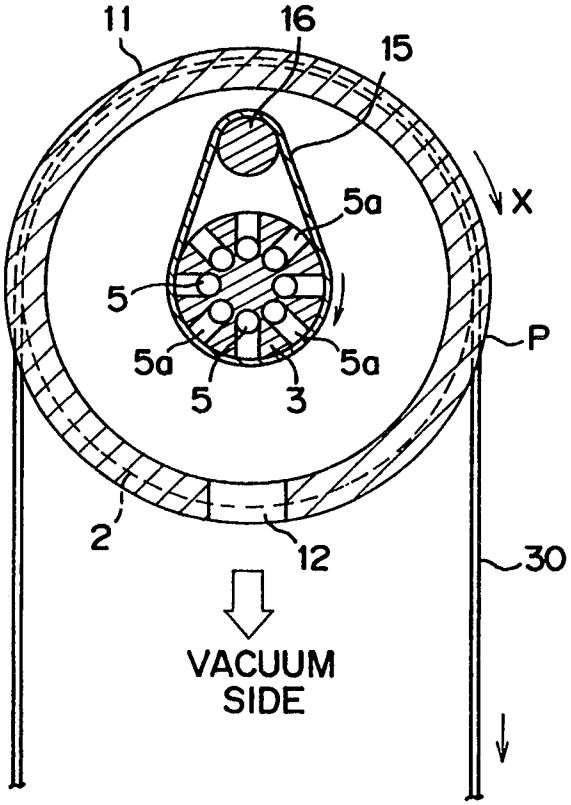
FIG. 3 is a sectional view of the suction roll, taken by a line III—III shown in FIG. 2.
Figure 4:
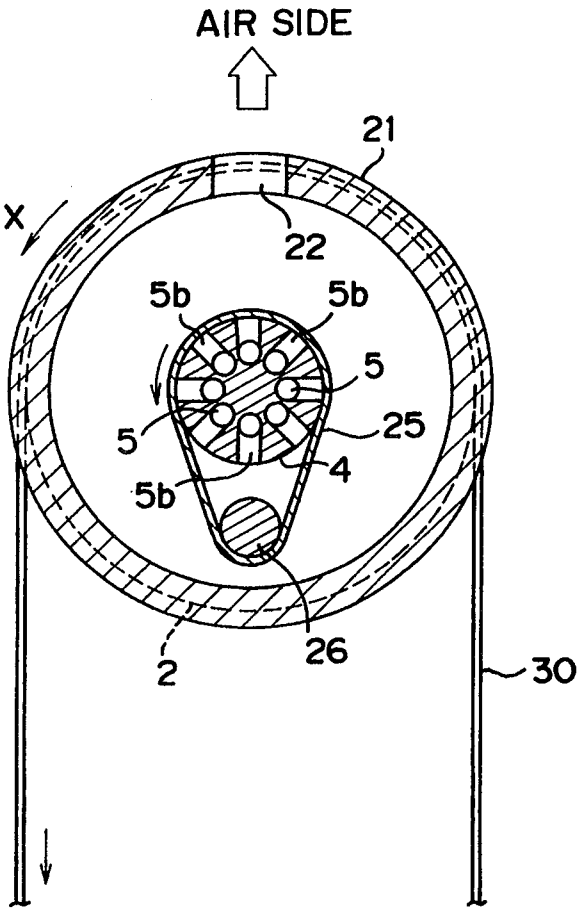
FIG. 4 is a sectional view of the suction roll, taken by a line IV—IV shown in FIG. 2.

Some exemplary suction rolls according to the present invention are hereinafter described with reference to the accompanying drawings.

First Embodiment: see FIGS. 1–4

A suction roll 1 according to the present invention comprises a roll body 2 in the center, shafts 3 and 4 which protrude from the roll body 2 at both sides, housings 11 and 21 which cover the shafts 3 and 4 respectively, and endless belts 15 and 25 which are provided in the housings 11 and 21 respectively.

In the roll body 2, a plurality of suction holes 5 are made such that each suction hole 5 extends along the axis of the roll body 2 and that the suction holes 5 make a concentric circle of the roll body 2. Each of the suction holes 5 is connected with the circumferential surface of the roll body 2 by a large number of pores 6. A rotating force is transmitted to the suction roll 1 through either the shaft 3 or the shaft 4, and the suction roll 1 rotates in a direction indicated with arrow X at a constant speed. A flexible strip 30 to be conveyed is wound around the roll body 2, and as the suction roll 1 is rotating, the strip 30 is turned and conveyed.

Next, a mechanism for applying suction to the strip 30 is described.

Each suction hole 5 extends between the shafts 3 and 4, and both end portions 5*a* and 5*b* thereof are bent to the circumferential surfaces of the shafts 3 and 4 respectively. The end portions 5*a* and 5*b* are bent in the same direction as the pores 6 extend to the circumferential surface of the roll body 2.

The housings 11 and 21 are fixed on a base (not shown) and the shafts 3 and 4 are fastened to the housing 11 and 21 by bearings 13 and 23 respectively such that the shafts 3 and 4 can freely rotate. The housing 11 is connected with a vacuum suction device (not shown) through an opening 12, and sealed by the bearing 13 and 23 so that the housing 11 serves as a negative pressure chamber. The housing 21 is open to the outside through an opening 22.

Further, in the housings 11 and 21, rollers 16 and 26 are rotatably fastened respectively. The belt 15 is wound around the roller 16 and the shaft 3 such that the belt 15 closes the ends 5*a* of the suction holes 5. Likewise, the belt 25 is wound around the roller 26 and the shaft 4 such that the belt 25 closes the ends 5*b* of the suction holes 5. The winding of the belt 15 in the negative pressure side (see FIG. 3) and the winding of the belt 25 in the air side (see FIG. 4) are symmetric, and the belts 15 and 25 rotate with the rotation of the suction roll 1. In the negative pressure side, the belt 15 opens the ends 5*a* of suction holes 5 which communicate with pores 6 being in contact with the strip 30 and closes the ends 5*a* of suction holes 5 which communicate with pores 6 being out of contact with the strip 30. In the air side, the belt 25 closes the ends 5*b* of the suction holes 5 which communicate with pores 6 being in contact with the strip 30 and opens the ends 5*b* of the suction holes 5 which communicate with pores 6 being out of contact with the strip 30.

In other words, the pores 6 being in contact with the strip 30 are connected with suction holes 5 each of which has an end 5*a* connected with the vacuum suction device and another end 5*b* cut off by the belt 25 from the outside. Thereby, the air pressures in these suction holes 5 are kept negative, and suction is applied to the strip 30 by the pores 6 upon the circumference of the roll body 2. On the other hand, the pores 6 being out of contact with the strip 30 are connected with suction holes 5 each of which has an end 5*b* open to the outside and another end 5*a* cut off by the belt 15 from the vacuum suction device. Accordingly, the vacuum suction device does not take in air through the latter pores 6, and the vacuum suction device can work efficiently. Also, since the pores 6 out of contact with the strip 30 are reliably kept open to the outside, the strip 30 will not coil around the roll body 2 during conveyance even if no tension is applied to the strip 30.

Second Embodiment: See FIG. 5

Figure 5:
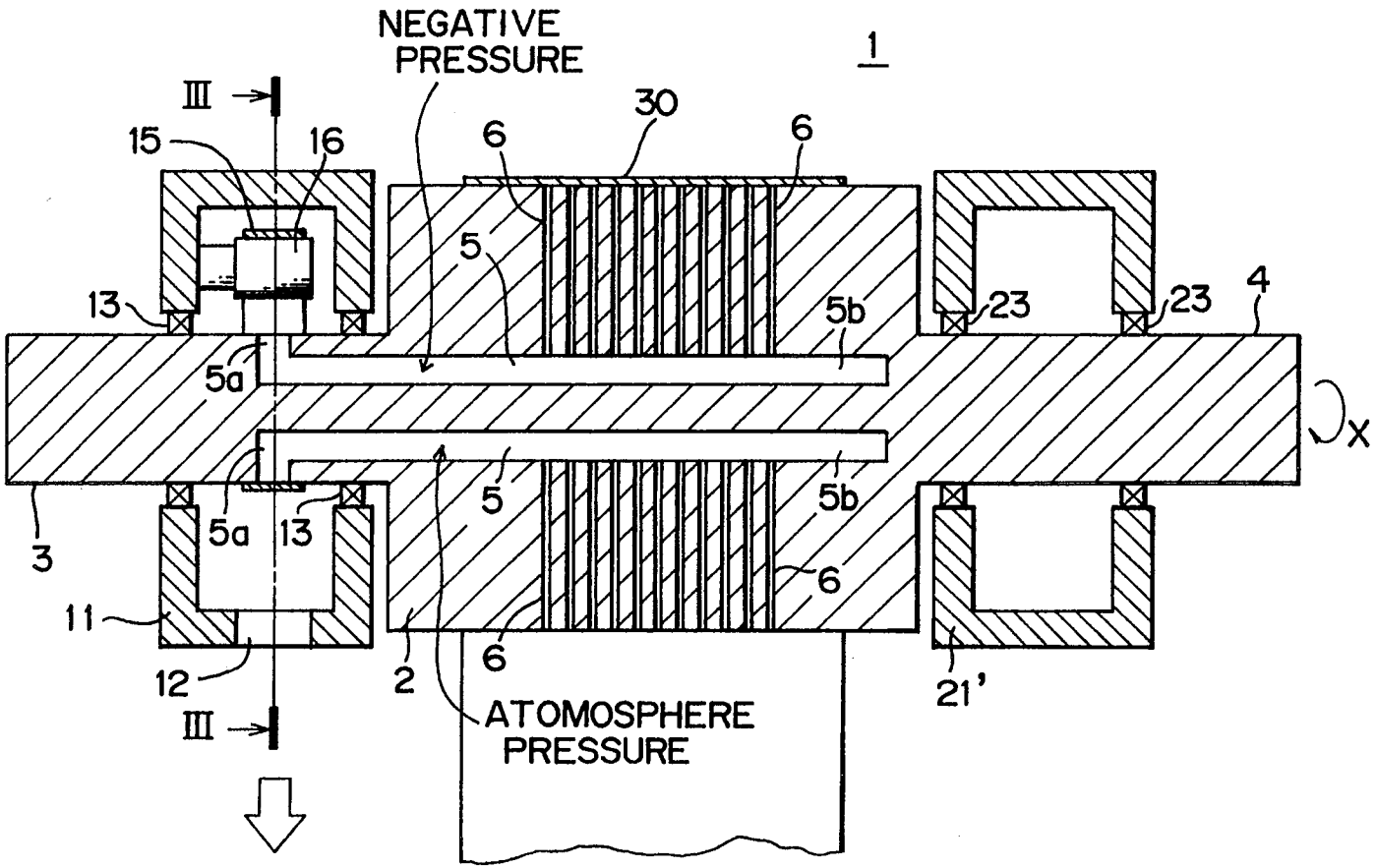
FIG. 5 is an elevational sectional view of a suction roll which is a second embodiment of the present invention.

In the first embodiment, two belts 15 and 25 for opening and closing the ends 5*a* and 5*b* of the suction holes 5 are provided. However, the belt 25 is dispensable. FIG. 5 shows an exemplary structure which can eliminate the belt 25. In this case, the ends 5*b* of the suction holes 5 are all closed.

Third Embodiment: See FIG. 6

Figure 6:
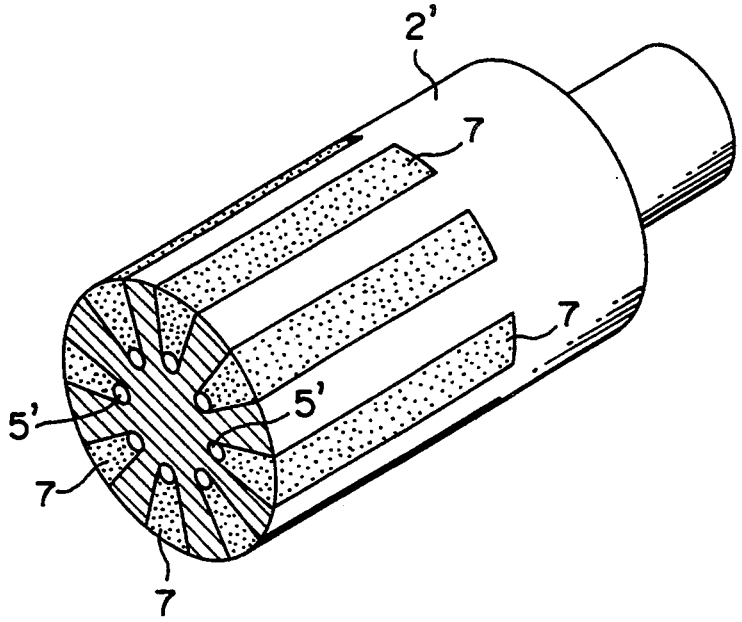
FIG. 6 is a perspective view of an essential part of a suction roll which is a third embodiment of the present invention.

FIG. 6 shows a suction roll which is a third embodiment of the present invention. In the third embodiment, porous segments 7 replace the pores 6 in the first and the second embodiments. The porous segments 7 are embedded in a roll body 2' such that each porous segment 7 is connected with each suction hole 5'. The segments 7 are sintered products with numerous pores or are resin molded products. The other parts of the third embodiment are the same as shown in FIGS. 1 through 4 or FIG. 5. A sectional view of the suction roll taken by a line III—III in FIG. 6 is the same as FIG. 3.

Other Embodiments

Although the present invention has been described in connection with the preferred embodiments above, it is to be noted that various changes and modifications are possible to those who are skilled in the art. Such changes and modifications are to be understood as being within the scope of the present invention.

The number of suction holes 5 and the number of pores 6 are arbitrary, but a large number of suction holes and pores secure the suction.

As means of opening and closing the suction holes 5, a mechanical means such as electromagnetic valves or mechanical valves operated by a cam can be used as well as the belts 15 and 25. In a case of using such valves, the valves are opened and closed in accordance with the rotation of the roll body.

What is claimed is:

1. A suction roll for applying suction to a flexible strip wound around its circumference and conveying the strip in one direction, said suction roll comprising:

a roll body which has inside a plurality of suction holes extending in a direction of an axis of the roll body such that the suction holes are distributed within the roll body about said axis, and the roll body has a large number of pores connecting each suction hole with a circumferential surface of the roll body;

a shaft which protrudes from the roll body at one side, one end of each suction hole reaching a circumferential surface of the shaft;

a negative pressure chamber formed around the shaft; and means for opening and closing the suction holes, the opening/closing means operating in accordance with rotation of the roll body to connect suction holes which communicate with pores in contact with the strip with the negative pressure chamber, and to cut off suction holes which communicate with pores out of contact with the strip from the negative pressure chamber.

2. A suction roll as claimed in claim 1, wherein the opening/closing means is an endless belt which is wound around the shaft in the negative pressure chamber so as to cover said suction holes to be cut off from the negative pressure chamber where said suction holes reach the shaft.

3. A suction roll as claimed in claim 1, wherein the pores extend from the suction holes straight to the circumferential surface of the roll body.

4. A suction roll as claimed in claim 1, wherein porous segments are embedded in the roll body so as to form the pores which connect the suction holes with the circumferential surface of the roll body.

5. A suction roll as claimed in claim 1, wherein the suction holes are distributed within the roll body to define a substantially concentric circle about said axis.

* * * * *